United States Patent [19]

Cooney et al.

[11] Patent Number: 4,660,922

[45] Date of Patent: Apr. 28, 1987

[54] TERMINAL PLUG BODY AND CONNECTOR

[75] Inventors: James S. Cooney, Attleboro; Stephen T. Sicard, Norton, both of Mass.

[73] Assignee: Pylon Company, Inc., Attleboro Falls, Mass.

[21] Appl. No.: 846,501

[22] Filed: Mar. 27, 1986

Related U.S. Application Data

[63] Continuation of Ser. No. 626,062, Jun. 29, 1984, abandoned.

[51] Int. Cl.[4] ..... H01R 13/00

[52] U.S. Cl. ..... 339/278 T

[58] Field of Search ..... 339/252 P, 256 R, 278 R, 339/278 T, 221 R, 221 M, 220 R; 403/280, 282

[56] References Cited

U.S. PATENT DOCUMENTS

| | | | |
|---|---|---|---|
| 2,040,674 | 5/1936 | Severance et al. | 339/278 R |
| 3,281,760 | 10/1966 | Oshima et al. | 339/278 R |
| 3,315,214 | 4/1967 | Davis | 339/275 R |
| 3,363,220 | 1/1968 | Redd et al. | 339/255 R |
| 3,786,558 | 1/1974 | McCarthy | 339/252 P |

FOREIGN PATENT DOCUMENTS

| | | | |
|---|---|---|---|
| 610214 | 6/1978 | U.S.S.R. | 339/256 R |

*Primary Examiner*—Neil Abrams

*Attorney, Agent, or Firm*—Weingarten, Schurgin, Gagnebin & Hayes

[57] ABSTRACT

A terminal plug body for interference-fit with a thin-walled annular end of an interconnection component makes possible a center-to-center spacing of adjacent interconnection components that is not limited except by the outside dimension of the adjacent components themselves. The terminal plug body includes a head portion and a tail portion. The head portion includes a first region over which the material of the thin-wall of the annular end elastically expands and a second region into which the material of the thin-wall of the annular end elastically collapses during interference-fit. The annular end of the interconnection component in this manner is repeatedly pluggable onto and off the terminal plug body each time reassuming its nominal shape without plastic deformation. A connector including the terminal plug body and any suitable interconnection component may with advantage be utilized.

14 Claims, 7 Drawing Figures

TERMINAL PLUG BODY AND CONNECTOR

This application is a continuation of application Ser. No. 626,062, filed 06-29-84, now abandoned.

FIELD OF THE INVENTION

This invention is directed to the field of interconnection devices, and more particularly, to a novel terminal plug body and connector.

BACKGROUND OF THE INVENTION

Electrical interconnection components commonly include a thin-walled tubular portion to which it is desirable to make mechanical and/or electrical connection. One such interconnection component, a spring-loaded POGO signal contact, includes a tubular socket portion and a spring-loaded plunger mounted for sliding motion within the socket with its contact head extending beyond an end thereof. Annular mounting rims are provided into which the other end of the tubular socket portions are inserted for mounting the POGO signal contacts to a test fixture in an intended contact pattern. With the ever decreasing size and component density of electronic circuit devices being tested by such text fixtures, however, the dimensions of the annular mounting rims establish an upper bound on the minimum possible center-to-center spacing of adjacent signal contacts, thereby limiting the utility of the test fixture in many applications.

SUMMARY OF THE INVENTION

The terminal plug body and connector of the present invention makes possible a center-to-center spacing smaller than heretofore possible, and therewith provides an improved density interconnection that is limited substantially only by the size of the signal contacts themselves. The terminal plug body of the present invention includes an enlarged head over which a thin-walled annular end of a POGO signal contact or other interconnection component is interference-fit. At least one beveled surface integrally formed with the enlarged head provides sufficient clearance to accomodate elastic deformation of the thin-walled annular end of the interconnection component. The at least one beveled surface is preferably planar, and axially extends along the head. In preferred embodiment, the enlarged head of the terminal plug body includes a central portion of comparatively large outside dimension, and axially spaced tapering surfaces integrally formed with the central portion and of comparatively smaller outside dimensions. The outside dimension of the enlarged head is selected to be larger than the inside dimension of the thin-walled annular portion of the interconnection component, but preferably not so large as to stress the thin-walled annular portion beyond its threshold of plastic deformation. A tail portion is integrally formed in axially spaced relation with the head, and a mounting flange is integrally formed intermediate the tail and the head. A test is provided on the end of the terminal plug body remote from the tail. A connector according to the present invention includes any suitable interconnection component such as a POGO signal contact or a socket PCB inset and the terminal plug body.

BRIEF DESCRIPTION OF THE DRAWINGS

These and other features and advantages of the present invention will become apparent as the invention becomes better understood by referring to the following exemplary and solely non-limiting detailed description of the preferred embodiments, and to drawings, wherein.

DETAILED DESCRIPTION OF THE PREFERRED EMBODIMENTS

Figure 1:
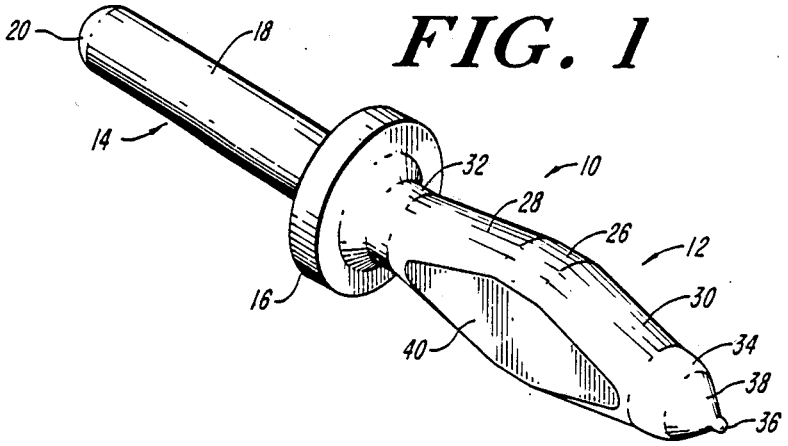
FIG. 1 is an isometric view of a novel terminal plug body according to the present invention.
Figure 2:
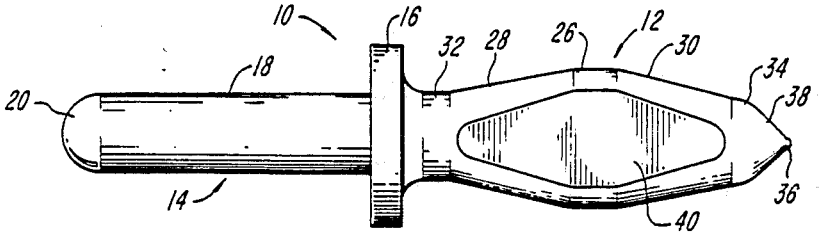
FIG. 2 is an elevational view of one side of the terminal plug body according to the present invention.
Figure 3:
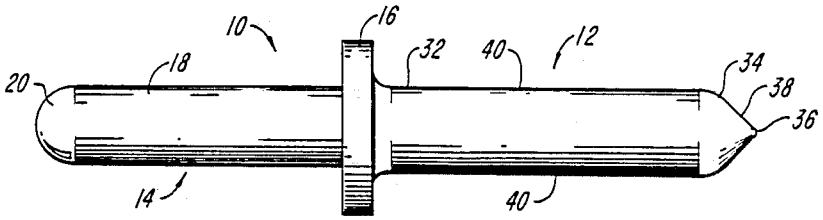
FIG. 3 is an elevational view of another side of the terminal plug body according to the present invention.

Referring now to FIG. 1, generally designated at 10 is an isometric view of the terminal plug body according to the present invention. The terminal plug body 10 includes a head portion generally designated 12, an integral tail portion generally designated 14, and an integral intermediate flange 16. The flange 16 provides an abutment when the terminal plug body 10 is mounted to a PCB, an ATE test fixture, or other mounting board. The tail 14 can have a comparatively short shaft 18 that terminates in a spherical end 20 as illustrated in FIGS. 1, 2, 3, and 5, and can have a comparatively long shaft 22 having a knurled section 24 for frictionally engaging the confronting wall of a PCB or other interconnection board as shown in FIG. 6, among any other suitable configurations.

The head 12 includes a central portion 26 of comparatively large outside dimension, and axially spaced tapering portions 28, 30 integrally formed with the central portion 26, and to either side thereof. The outside dimension of the central portion is selected to be larger than the inside dimension of a thin-walled annular end of an interconnection component to be received thereover but not so much larger as to stress the thin-walled annular portion beyond the plastic deformation threshold of the material of the wall. End portions 32, 34 having outside dimensions selected to be no larger than the inside dimensions of the thin-walled annular portion of the interconnection component to be received over the head 12 of the body 10 are integrally formed with the ends of the tapering portions 28, 30 remote from the central portion 26 of the head 12. The portions 28, 30 are preferably frusto-conical, and the surface 26 is preferably cylindrical. A teat 36 is integrally formed with the end of the head 12 remote from the tail 14. A rounded portion 38 having outside dimensions everywhere smaller than the dimensions of the portions 30, 34 is provided between the end portion 34 and the teat 36 to facilitate plugability of the thin-walled annular end of the interconnection component over the head of the terminal plug body.

Figure 4:
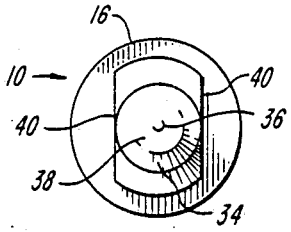
FIG. 4 is a plan view of the head end of the terminal plug body according to the present invention.

The nose 12 includes at least one beveled surface 40 that axially extends along the nose 12 and through the nose portions 26, 28, 30. Preferably, two such surfaces 40 are diametrically formed on the nose 12, and are preferably planar. As can best be seen in FIGS. 3 and 4, the surfaces 40 are preferably formed on the nose 12 tangent to, and on opposite sides of, the outside diameter of the portion 34. The tangent planar beveled surfaces 40 provide sufficient clearance to accomodate elastic collapse of the thin walled annular end of the interconnection component that is intereference-fit over the head 12 of the terminal plug body 10.

Figure 5A:
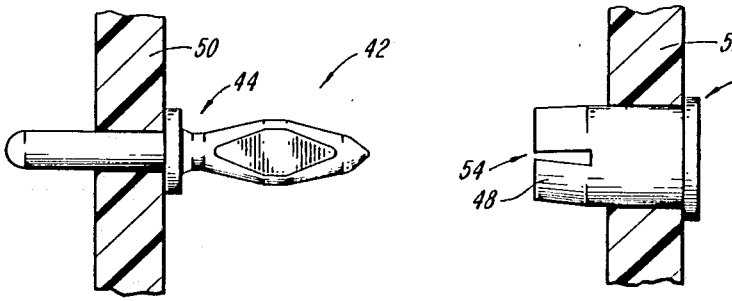
FIG. 5A is a sectional view of one embodiment of a connector according to the present invention.
Figure 6:
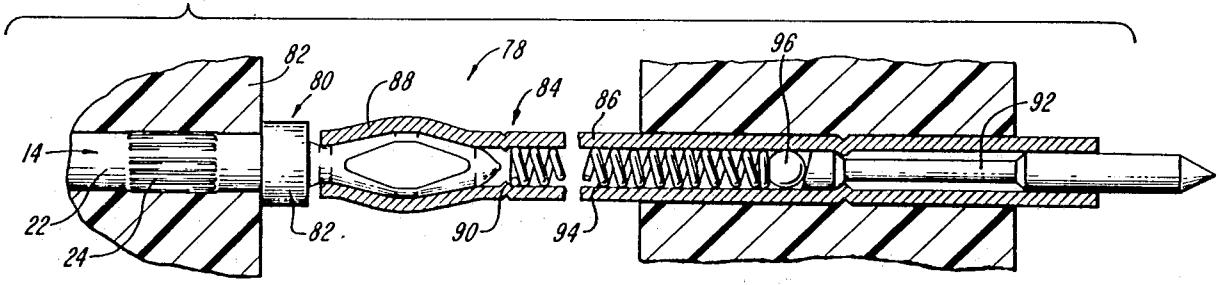
FIG. 6 is a sectional view of a further embodiment of a connector according to the present invention.

Referring now to FIG. 5A, generally designated at 42 is one embodiment of a connector according to the present invention. The connector 42 includes a terminal plug body generally designated 44 of the type described above in connection with the description of FIGS. 1–4 that mates with a socket generally designated 46 having a thin walled annular interconnection end 48. The terminal plug body 44 is mounted to an interconnection board 50, and the socket 48 is mounted to an interconnection board 52. A slot generally designated 54 may be provided in the wall 48 to allow radial expansion of the wall 48 as induced by its interference-fit over the enlarged head of the body 44.

Figure 5B:
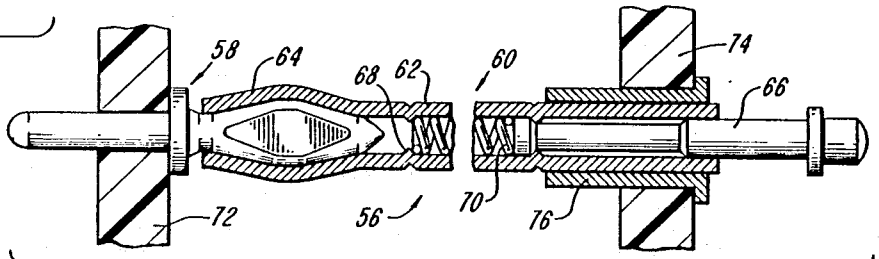
FIG. 5B is a sectional view of another embodiment of a connector according to the present invention.

Referring now to FIG. 5B, generally designated at 56 is another embodiment of a connector according to the present invention. The connector 56 includes a terminal plug body generally designated 58 of the type as described above in connection with the description of FIGS. 1–4, and a POGO signal contact generally designated 60. The POGO contact 60 includes a sleeve 62 having a thin-walled annular interconnection end 64. A plunger 66 is mounted for sliding motion in the sleeve 62. An annular flange 68 is provided interiorly of the sleeve 62, and a spring member 70 is mounted in the sleeve between and abutting the annular flange 68 and the plunger 66. The terminal plug body 58 is mounted in an interconnection board 72, and the POGO signal contact 60 is mounted in an interconnection board 74 via a sleeve 76 provided therefor.

The annular end 64 of the POGO contact 60 is slidably received over the terminal plug body 58. The material of the thin-walled annular end 64 elastically expands and conforms to the geometry of the head, and in such a way that the clearances provided by the planar beveled surfaces thereof accomodate the elastic collapse of the material as it expands over the enlarged head without stressing it beyond its threshold of plastic deformation. The thin-walled annular end thus resumes its nominally cylindrical shape as it is unplugged from the head of the terminal plug body. The POGO signal contact may thereby be repeatedly plugged and unplugged thereon and therefrom without plastic damage to the interconnection component. It will be appreciated that adjacent signal contacts can be placed with a center-to-center spacing that is bounded substantially only by the dimensions of the signal contact itself.

Referring now to FIG. 6, generally designated at 78 is another embodiment of a connector according to the present invention. The connector 78 includes a terminal plug body generally designated 80 substantially similar to the terminal plug body described above in connection with the description of the FIGS. 1–4 except that it has an intermediate flange 82 of increased axial thickness and, as described above, has a tail 14 having a shaft 22 of comparatively larger physical extension that includes a knurled region 24, and a POGO signal contact generally designated 84. In the embodiment of FIG. 6, the terminal plug body 80 is mounted into a terminal plug body mounting board 82. The contact 84 includes a sleeve 86 having a thin-walled annular interconnection end 88 and an annular flange 90 formed on the inside of the sleeve. A plunger 92 is slideably mounted in the sleeve and is biased outwardly by a spring 94 and ball 96 positioned between the annular interior flange 86 and the plunger 92.

As in the embodiment of FIG. 5, the POGO signal contact 84 can be repeatedly plugged and unplugged from the terminal body, and maintains its nominal cylindrical shape without distortion providing for a long life of useful operation. The shape of the plug, and the dimensions of the plug relative to the thin-walled annular end of the interconnection component, can be controllably adjusted to provide an intended degree of interference-fit. The tube materials, hardness, and thickness can be selected to provide an intended insertion and withdrawal force. In the presently preferred embodiments, the terminal plug body is formed of a copper alloy such as beryllium copper that is heat treated and gold plated. The POGO signal contacts preferably have a sleeve of hardened beryllium copper that is gold-plated, and the plungers of the signal contacts are preferably formed of hardened beryllium copper that is gold-plated. The shafts thereof can advantageously be formed of gold-lined nickel silver.

Many modifications of the presently disclosed invention will be apparent to those skilled in the art without departing from the scope of the appended claims.

What is claimed is:

1. A terminal plug for electrical and mechanical connection into a thin-walled annular end of an interconnection component, said thin-walled annular end having a predetermined inside dimension, comprising:

a tail portion; and a head portion integrated with said tail portion in an axial direction, said head portion having variable transverse dimensions in said axial direction inducing tensile stresses in said thin-walled annular end when said head portion is inserted into said thin-walled annular member, said head portion further comprising, a tapered end portion axially distal of said tail portion, a first tapering portion integrated with said tapered end portion, said first tapering portion having increasing traverse dimensions in said axial direction towards said tail portion such that insertion of said terminal plug into said thin-walled annular end causes an increasing tensile stress to be induced in corresponding segments of said thin-walled annular end by said first tapering portion, a central portion integral with said first tapering portion, said central portion having a constant transverse dimension slightly greater than said predetermined inside dimension of said thin-walled annular end such that insertion of said terminal plug into said thin-walled annular end induces a maximum tensile stress in corresponding segments of said thin-walled annualar end by said central portion, a second tapering portion integral with said central portion and integrated with said tail portion, said second tapering portion having decreasing transverse dimensions in said axial direction towards said tail portion such that insertion of said terminal plug into said thin-walled annular end causes a decreasing tensile stress in corresponding segments of said thin-walled annular end causing elastic collapse thereof onto said second tapering portion, and at least one beveled surface extending in said axial direction and formed through said first tapering portion, said central portion, and said second tapering portion such that when said terminal plug is inserted into said thin-walled annular end said at least one beveled surface cooperates with a segment of said thin-walled annular end to provide clearance to accommodate elastic collapse of that segment, whereby when said terminal plug is inserted into said thin-walled annular end said first tapering portion, said central portion and said second tapering portion of said head portion are maintained in physical contact with said thin-walled annular end due to tensile stresses induced therein, and the probability of fatigue failure of said thin-walled annular end due to repeated connection of said terminal plug is significantly reduced by the uneven tensile stress distribution induced in said thin-walled annular end by said body portion of said terminal plug.

2. The terminal plug as claimed in claim 1 wherein said first tapering portion further comprises a frusto-conical configuration, and wherein said second tapering portion further comprises a frusto-conical configuration.

3. The terminal plug as claimed in claim 1 wherein said central portion further comprises a cylindrical configuration.

4. The terminal plug as claimed in claim 1 wherein said at least one beveled surface comprises a planar surface.

5. The terminal plug as claimed in claim 1 wherein said at least one beveled surface comprises a first beveled surface and a second beveled surface, said first beveled surface being in a diametrically opposed relationship with said second beveled surface.

6. The terminal plug as claimed in claim 5 wherein said first beveled surface comprises a first planar surface, and wherein said second beveled surface comprises a second planar surface.

7. The terminal plug as claimed in claim 1 further including an annular flange intermediate said tail portion and said body portion integrating said body portion with said tail portion.

8. The terminal plug of claim 1 further including a first end portion intermediate said tapered end portion and said first tapering portion integrating said first tapering portion and said tapered end portion, said first end portion having a constant transverse dimension no greater than said predetermined inside dimension of said thin-walled annular end, and a second end portion intermediate said second tapering portion and said tail portion integrating said second tapering portion and said tail portion, said second end portion having a constant transverse dimension no greater than said predetermined inside dimension of said thin-walled annular end.

9. The terminal plug of claim 8, wherein said first end portion further comprises a cylindrical configuration, and wherein said second end portion further comprises a cylindrical configuration.

10. The terminal plug as claimed in claim 7 further including a first end portion intermediate said tapered end portion and said first tapering portion integrating said first tapering portion and said tapered end portion, said first end portion having a constant transverse dimension no greater than said predetermined inside dimension of said thin-walled annular end, and a second end portion intermediate said second tapering portion and said annular flange integrating said second tapering portion and said annular flange, said second end portion having a constant transverse dimension no greater than said predetermined inside dimension of said thin-walled annular member.

11. The terminal plug of claim 10 wherein said first end portion further comprises a cylindrical configuration, and wherein said second end portion further comprises a cylindrical configuration.

12. The terminal plug of claim 1 further including a teat formed on the free end of said tapered end portion in an axially symmetric manner.

13. The terminal plug of claim 1 wherein said tail portion further comprises an axially extending shaft, said axially extending shaft having a tapered configuration at the free end thereof.

14. The terminal plug of claim 13 wherein said exially extending shaft further includes a knurled surface.

* * * * *